United States Patent [19]

Doll

[11] Patent Number: 4,850,113

[45] Date of Patent: Jul. 25, 1989

[54] HONEYCOMB SIGHT

[76] Inventor: Donald A. Doll, 4739 S. 1900 East, Ogden, Utah 84403

[21] Appl. No.: 155,733

[22] Filed: Feb. 16, 1988

[51] Int. Cl.[4] ..... F41G 1/42

[52] U.S. Cl. ..... 33/233; 33/261

[58] Field of Search ..... 33/234, 233, 227, 228, 33/261, 264, 245; 42/100–103

[56] References Cited

U.S. PATENT DOCUMENTS

| | | | |
|---|---|---|---|
| 1,089,086 | 3/1914 | Sikes | 33/233 |
| 2,436,453 | 2/1948 | Schulz | 33/233 |
| 3,190,002 | 6/1965 | Bliss | 33/233 X |
| 4,034,480 | 7/1977 | Mehrtens | 33/227 X |

FOREIGN PATENT DOCUMENTS

| | | | |
|---|---|---|---|
| 684319 | 11/1939 | Fed. Rep. of Germany | 33/261 |

*Primary Examiner*—Harry N. Haroian

*Attorney, Agent, or Firm*—Trask, Britt & Rossa

[57] ABSTRACT

A sight for a line-of-sight weapon has a plurality of elongated tubes with a longitudinal axis in alignment with the sight axis of the line-of-sight weapon with each of the tubes having a length to diameter ratio selected to be greater than about 4:1. The tubes are positioned within an assembly structure such as a sheath. A mounting structure is attached to the sheath to mount the sight to the desired weapon. The tubes are formed into a honeycomb structure with common sides and with a central or main tube plugged to preclude sight therethrough.

28 Claims, 2 Drawing Sheets

HONEYCOMB SIGHT

BACKGROUND OF THE INVENTION

Field: This invention relates to sighting mechanism for use with various kinds of line-of-sight weapons such as hand and shoulder weapons.

BACKGROUND

A wide variety of line-of-sight weapons are well known. Handguns or pistols, shoulder weapons such as rifles and shotguns, cross bows, bows, machine guns, and the like all may be viewed as line-of-sight weapons. Even large naval weapons, tankguns and field artillery may be fired on a line-of-sight basis from time to time. To be a line-of-sight weapon, the user visually has eye contact with the target and aligns the weapon to launch a projectile (e.g., bullet, arrow, shell) toward the target with a desired objective of striking the target with the projectile.

A wide variety of sight mechanisms have been devised to facilitate the task of aligning a weapon so that its projectile will strike the target. Such sights include telescopic sights, peep sights, open sights, rib sights, sights employing various mechanisms to take into account windage and elevation, and notch sights. It is understood that the various sights have all been devised based on the nature of the weapon and the desired use.

Typical sight structures involve a forward and a rearward component that are placed in a desired alignment which may be viewed as the sight axis so that upon launching, the projectile will proceed in the desired direction in order to strike the target. Quite simply, the sight is misaligned with the projectile axis so that when the projectile is launched, it will follow a trajectory (e.g., loft or arc) to and strike the target at the point where the user intended.

Sights involving the forward and rearward structure require the user to first focus on the near object which is the sight and then a far object which is the remote target. Even with a short range weapon such as a pistol being fired at a range of five or ten yards, the user is required first to focus on the weapon sight which is within a few feet of the user's eye and then the target which is typically some additional distance away. Thus, in effect the user is required to focus near and then far. As a result, the sighting of a weapon such as a pistol requires practice and some level of skill in order to obtain proficiency. It also takes time and obligates the user to concentrate on the sight and not the target, and then vice versa.

SUMMARY OF THE INVENTION

The sight of the instant invention includes a tube bundle comprised of a plurality of elongated tubes. Each of the tubes is sized in cross section for visual sight therethrough. One of the tubes is a main tube having a longitudinal axis which is substantially parallel with the sight axis of a line-of-sight weapon. Mounting means are mechanically associated with the tube bundle for mounting the tube bundle to the line-of-sight weapon with the axis of the main tube substantially parallel or in alignment with the sight axis of the line-of-sight weapon.

Desirably, each of the plurality of the elongated tubes are of substantially the same length and substantially the same cross section. Preferably, the main tube is centrally disposed within the bundle.

In one embodiment, the main tube is surrounded by the other tubes of the bundle. The other tubes each have a distal end which is oriented toward the front of the line-of-sight weapon and a proximal end oriented toward the back of the line-of-sight weapon. The proximal end has a cross section larger than the distal end. The other tubes each have a longitudinal axis and are positioned so that their respective longitudinal axis intersects the longitudinal axis of the main tube at a point toward the front of the weapon.

The sight mechanism may also include an assembly means which is sized and shaped to hold the tube bundle together. The assembly means may be comprised of a forward and rearward spaced apart bracket structure or a sleeve structure, each formed and sized to rigidly hold the tubes on the tube bundle.

In another embodiment, the tube bundle preferably has a height and width, where the width is larger than the height. In yet another arrangement, the elongated tubes may be substantially circular in cross section or ovate in cross section. Yet in another embodiment, the elongated tubes may be multi-sided structures having at least three sides. Two of the multi-sided tubes may preferably have a first common side.

In yet another arrangement, each tube of the plurality of tubes has a length dimension and a diameter dimension which are selected so that each tube has a length dimension to diameter dimension ratio of at least 4:1.

In an alternate arrangement, the length dimension and diameter dimension are selected to provide an observable shadow area upon sighting through the tube, not along the longitudinal axis of the tube and at a sight distance from the tube selected so the user is able to see into a selected plurality of tubes.

In another variation, the sight may include cross-hair structure which are positioned to have a cross hair intersection on the longitudinal axis of the main tube. In an alternative configuration, the tube bundle has a main tube centrally disposed and plugged to prevent sight therethrough.

In yet another form, the tubes each have a first side and a second side joined along one edge thereof to form a corner. The sides are formed together into a honeycomb structure with the corners each substantially parallel to the sight axis of the line-of-sight weapon.

In an alternate arrangement, a partial tube means may be added to the tube bundle. The partial tube means is a plurality of elongated tubes each with an open side wall portion facing outwardly from the tube bundle.

DESCRIPTION OF THE DRAWINGS

In the drawings which presently illustrate what are regarded to be the preferred embodiments.

DESCRIPTION OF THE ILLUSTRATED EMBODIMENT

Figure 1:
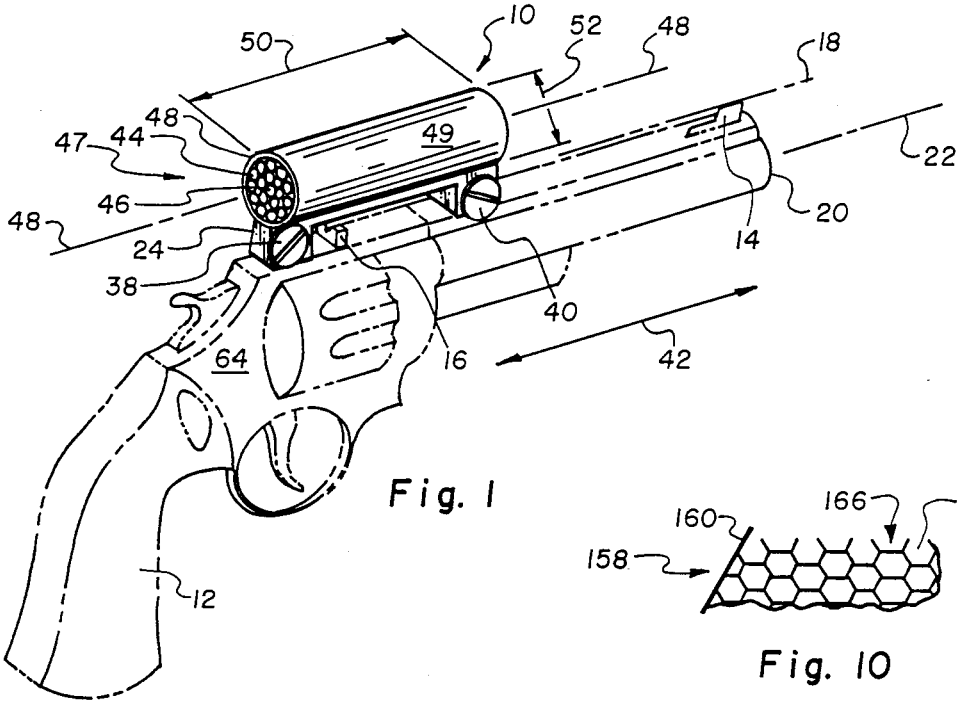
FIG. 1 is an illustration of the sight of the instant invention adapted to a handgun shown in phantom; .

FIG. 1 shows a line-of-sight weapon such as the handgun shown in phantom, generally depicted by the number 12. The handgun 12 may be regarded as a line-of-sight weapon in that its proper alignment in order to launch the projectile (bullet) toward a target is accomplished by aligning a front or muzzle sight structure 14 with a rear or breach sight structure 16. The sights 14 and 16 properly align sight axis 18 so that when a projectile proceeds out the muzzle 20 of the weapon, it proceeds along the weapon axis 22 to eventually strike the target at the desired location in a manner well known in the art.

Figure 2:
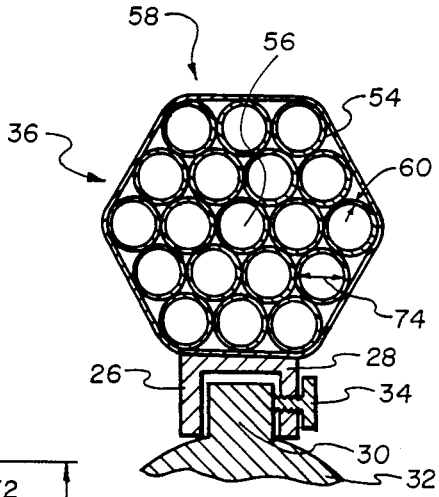
FIG. 2 is a cross section of a sight similar to the sight of FIG. 1.

The sight 10 of the instant invention is here shown adapted to the line-of-sight weapon or gun 12 by mounting means 24 which is similar to the mounting means 26 seen in FIG. 2. That is, the mounting means is here formed to be a "C" shaped structure 28 sized to bridge the barrel rib 30 of the handgun 32 shown only in partial cut away. A set screw 34 securely adapts the sight 36 of FIG. 2 to the handgun 32 of FIG. 2. Similarly, in FIG. 1 the set screws 38 and 40 adapt the mounting means 24 to the weapon.

It should be readily understood that different mounting means will be required for different line-of-sight weapons. For example, present sight structures used for bows such as recurve or compound bows are well known. Such bows in many cases contain or have a female thread structure embedded in the handle of the bow at a desired location so that a sight may be readily threaded thereto for use in operation of that bow.

Similarly, mounting means may be different for shot guns, rifles or other weapons. Various types of clamps, set screws or the like may be used to removably but securely adapt the sight of the instant invention to the particular line-of-sight weapon. In some cases, the user may elect to glue or even solder or weld a sight to a particular weapon.

In all cases, the mounting means functions to mount the sight of the instant invention to the desired weapon in a desired location with a proper alignment, as more fully discussed hereinafter.

In can be seen that the sight 10 in FIG. 1 has been positioned rearwardly or at the breech end 64 of the handgun 12. However, it should be understood that the sight 10 may be positioned at any desired location along the length 42 of the handgun 12.

The sight 10 can be seen to include a plurality of tubes 44, any one of which may be selected and designated as a main tube. The main tube 46 is here seen to be centrally disposed within the bundle 47. The main tube 46 has a longitudinal axis 48 which is substantially parallel to the sight axis 18 of the gun 12. That is, it is positioned by sighting the weapon at a gunnery range and aligning the sight 10 and its axis 48 so that a projectile will proceed as intended under given conditions as known in the art. Of course, each of the tubes 44 including the main tube 46 is sized and cross sectioned for visual sight therethrough.

It may be further seen in FIG. 1 that the tube bundle 47 which is the plurality of elongated tubes 44 and main tube 46 is contained within an assembly means which is here illustrated as a solid cylinder or sleeve 49 fixedly adapted to the mounting means 24. The cylinder 49 may be fixedly adapted to the mounting means 24 by welding, gluing or any other means desired by the user by which one structure can be securely and firmly mounted to another.

It may also be seen in FIG. 1 that the sight 10 has a length 50 and an overall diameter 52. The diameter 52 is selected in relation to the line-of-sight weapon 12 and the size or field of view of the target. For example, for handgun 12 of the type illustrated, the diameter 52 of the sight 10 may be selected to be from about ½ of one inch to about 2 inches. Of course, in some circumstances the slightly smaller or slightly larger dimension may be preferred. The length 50 is typically selected to be less than the length 42 of the weapon 12. However, for some weapons such as bows, the length 50 may be longer. In FIG. 1, the length 50 is selected to be about two inches.

Referring back to FIG. 2, an alternate sight 36 is illustrated. Similar to the sight 10 of FIG. 1, the sight 36 of FIG. 2 is comprised of a plurality of tubes 54, one of which is a main tube 56. Here the main tube 56 is selected to be the centrally disposed tube within the tube bundle 58.

As seen in FIG. 2, each tube 54 is formed to have a wall thickness 60 which is relatively thin. That is, the wall thickness 60 is selected to be as thin as possible while still maintaining structural rigidity of the individual tubes 54 of the tube bundle 58. A wall thickness 60 of about 0.001 to 0.01 is contemplated for a sight of the type illustrated in FIG. 2 and FIG. 1.

Figure 3:
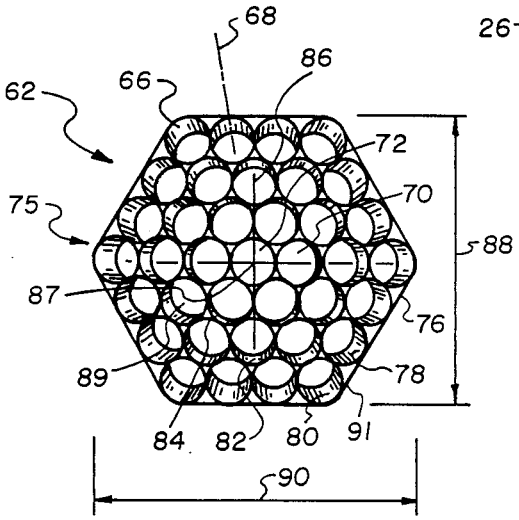
FIG. 3 is an end view of a sight of the instant invention similar to the sight of FIG. 2.

Referring now to FIG. 3, a sight 62 similar to the sight 36 is seen from an end view looking toward the target of a line-of-sight weapon such as from the rear or breech end 64 toward the muzzle or front end 20 of the gun 12. The sight 62 of FIG. 3 has a plurality of elongated tubes 66, each having a longitudinal axis 68. The tubes 66 are here sized to each have the same cross section along their respective axial lengths. However, it should be noted that tubes of different uniform cross section may be assembled into a sight of the type herein contemplated. That is, the tubes 70 surrounding the main tube 72 may be of substantially smaller or larger diameter than tube 72 depending upon the desires of the user. As long as the cross sectional area is selected so that the user can see through the tube, different sizes may be used. For round tubes such as the tubes 54 and 56 (FIG. 2) and tubes 66 and 70 (FIG. 3), the diameter 74 is proportional to cross section. However, other shaped tubes (in cross section) may be used (e.g., ovate, triangular, diamond) and involve other actual or calculated parameters which are used to equate to or which are reflective of diameter.

The tubes 66, 70 and 72 of FIG. 3 are all part of the illustrated tube bundle 75 assembled within the sheath 76. The inside walls 78 of each of the tubes illustrated are preferably coated with a darkening material such as, for example, carbon black or some other dull non-reflective coating, so that in use the interior walls 78 will not be reflective or shiny. Thus, when the user has properly aligned the sight, such as sight 62, with the main tube 72 directly on the target, the surrounding tubes all have a shadow areas, such as shadow areas 80, 82 and 84. With practice, the user will be able to balance the shadow areas as they appear so that the sight 62 and in turn the line-of-sight weapon will be properly aligned to launch the projectile accurately toward the target.

FIG. 3 illustrates a sight of the instant invention with a cross hair structure 86 positioned at the forward or muzzle end of the sight 62 with a cross hair 87 centrally disposed within the main tube 72 which is also centrally disposed within the tube bundle of the sight 62. As can be seen in FIG. 3, the sight 62 has the main tube 72 centrally disposed with six tubes immediately surrounding it such as tube 70. Surrounding the six tubes plus the main tube 72 is yet another ring of twelve tubes such as tube 89.

That is, the sight of the instant invention including sight 62 may be of virtually any geometric cross section. In FIG. 1 the cross section is circular. In FIGS. 2 and 3, the cross section is polygonal (e.g., 6 sided). With the cross sectional area known, a simple calculation can be performed using the formula $A=k\ r^2$, where A equals cross section area, k equals the constant pi, and r equals radius (or half the diameter). That is, with A known, one can solve for r and determine an effective diameter. The sight 62 of FIG. 3 has a height 88 and a width 90. The height 88 and width 90 can be used to calculate the cross section of the entire sight 62 which in turn can be used to calculate the effective diameter of the sight, even though the sight is not a circle. With the length (such as length 50 of sight 10) of the sight known, the length to effective diameter can be determined for the entire sight. Even though the effective diameter is controlled to some extent by the weapon and usage, a sight length to effective diameter ratio of about 2 to 1 to about 4 to 1 have been found desirable when the effective diameter is selected to be no less than about one inch.

It may further be noted that each of the tubes such as tube 66 of the sight 62 of FIG. 3 may be of other geometrical shapes. For example, each tube may be oval or ovate in cross section. It may also be triangular or of some other polygonal shape, some of which are discussed and illustrated hereinafter. It should also be noted that the sights such as sight 62 may have a larger number of tubes or more tube rings extending outwardly from the centrally disposed tubes such as tube 70 and 72. Alternately, the tubes may be considerably smaller so that for a sight substantially the same height 88 and width 90, a considerably larger number of tubes exist in the tube bundle 75. That is, the number of tubes such as tube 66 within the tube bundle 75 of the sight 62 may be such that sighting or aiming by the user at a preselected sight distance (as hereinafter discussed) will only be through a selected portion of the total number of tubes in the tube bundle. A selected plurality of tubes will be operative as the sight while tubes farther out toward the perimeter 91 will be dark due to their angle from the user's eye. The tubes are dark or shadowed because sight therethrough is not possible with the sight in proper alignment toward the target.

It should be noted that the sight 62 of FIG. 3 does not have a mounting means associated with it. However, any convenient mounting means may be adapted to it by welding, gluing or other appropriate means of securement, so that it may be adapted to an appropriate line-of-sight weapon.

Figure 4:
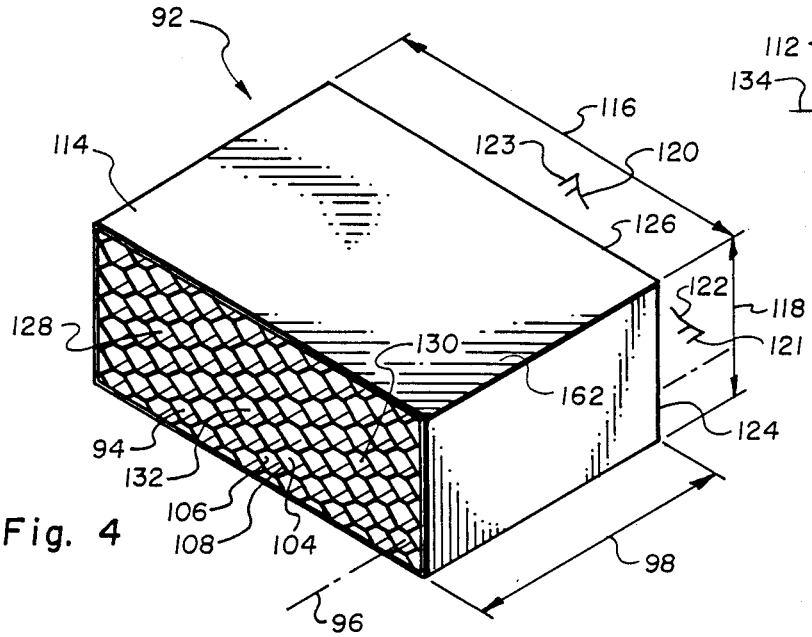
FIG. 4 is a perspective view of a honeycomb sight structure of the instant invention.

Referring now to FIG. 4, an alternate sight 92 is illustrated. It is similarly comprised of a plurality of tubes such as tube 94, each of which desirably or preferably has a longitudinal axis 96. The sight 92 preferably has a main tube which here can be any one of the tubes such as tube 94 since all of the tubes illustrated are in effect in axial alignment along their respective lengths. That is each of the tubes are substantially of the same length 98 and also substantially of the same cross section along their lengths.

Figure 5:
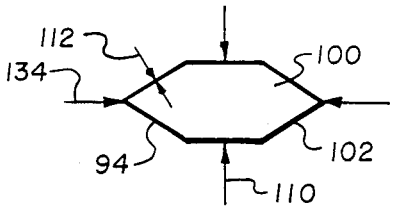
FIG. 5 is a cross sectional representation of single tube of the honeycomb structure of FIG. 4.

FIG. 5 illustrates one of the tubes such as tube 94 of FIG. 4 in cross section. The cross section 100 is in effect the area within the six sides 102 of the tube 94.

As noted before, the sight 92 of FIG. 4 has a main tube which may be any one of the tubes such as tube 94. The tubes are assembled to be in the form of a honeycomb (in cross section) structure. By use of a honeycomb structure, all of the area of the sight except for that area blocked by the side wall such as side wall 102 (FIG. 5) is available for sighting upon a target. A honeycomb structure is preferred since two adjacent tubes such as tube 106 and 108 have a common side wall 108. Similarly, all the other tubes such as tube 94 have a common side wall with an adjacent tube. Further, the use of a honeycomb structure permits construction of the side wall from a very thin material. For example, with a tube height 110 (FIG. 5) $\frac{1}{8}$ of one inch, the wall thickness 112 (FIG. 5) may be approximately 0.001 inch. At the same time the honeycomb structure is still lightweight but with sufficient rigidity to maintain tube alignment, particularly if the material of construction is aluminum or some similar material susceptible to thin wall extrusion.

The sight 92 of FIG. 4 is positioned within a sheath 114 to rigidly support and hold the honeycomb structure therewithin. Mounting means (not shown) may be adapted to the sheath 114 to fix the sight to an appropriate line-of-sight weapon. In the case of the sight 92, it may be noted that it has a width 116 substantially larger than its height 118. A sight such as sight 92 may be suitable for use with a line-of-sight weapon which requires aiming at fast moving objects such as ducks or geese, as they may be targets for a line-of-sight weapon such as a shotgun. Devices such as ticks 120 and 122 may be positioned along vertical edge 124 and the horizontal edge 126 of the sight 92. That is, the ticks are shown to have certain clamps 121 and 123 to clamp about and onto the sheath 114 and extend inwardly in the sight. The ticks 120 and 122 may be sized to extend sufficiently into the field of vision of the sight so that the user may be able to make adjustments for speed and distance based on experience or prior tests. Thus, the user might very well align the sight 92 with tube 128 in alignment with the target if the user where leading the target to the right and with tube 130 if the user where leading the target to the left assuming that a central tube such as tube 132 positioned with its longitudinal axis such as axis 96 centrally on the line-of-sight weapon and more particularly with its axis such as axis 96 in alignment with the sight axis of the line-of-sight weapon. Height or range adjustments are similarly made by use of the adjustable tick 122. Other tick structures may be employed by the use of screws, clamps, clips or the like as desired The diameter of the six sided tube such as tube 94 is really the height such as height 112 of the tube and not the width 134 of the tube 94 (FIG. 5). In other words, it has been found convenient to use the height 112 as the appropriate dimension for the diameter of the tube 94 even though it is not truly a diameter. Thus, the length to diameter ratio is in reality the length dimension to diameter dimension ratio of tubes such as tube 96 which are not circular in cross section. Here the height 112 is selected to be about ⅛ of an inch and the length 98 is selected to be about 2 inches. Thus, the tubes of the sight 92 have a length dimension to diameter dimension ratio of about 16:1.

Figure 6:
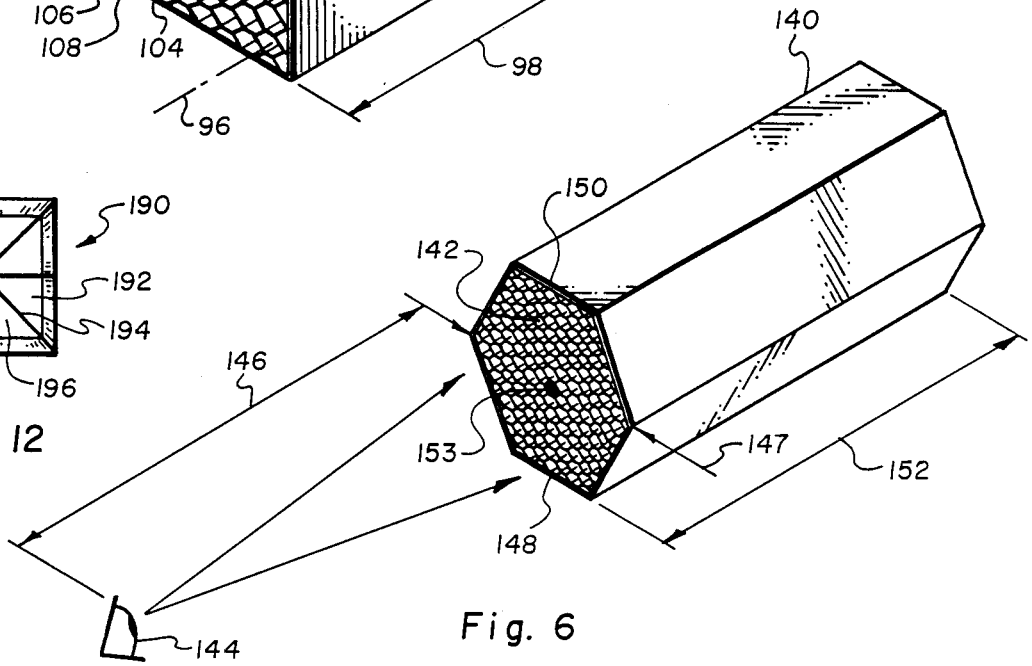
FIG. 6 is an alternate honeycomb sight structure of the instant invention.

Another form of a sight 140 is shown in FIG. 6 arranged similar in configuration to the sights 36 and 62 of FIGS. 2 and 3, respectively. Here, however, the tube bundle 142 is a honeycomb structure similar in form and shape to that of sight 92 with the effective diameter dimension of each tube similar to height 110 (FIG. 5) which is selected to be 1/16 of an inch.

For the sight 140 to be useful, a user must be able to see through a selected portion of the individual tube bundle 142. Thus, the user must have his or her eye 144 positioned at a selected distance 146 which is here selected to be the sight distance 146. If the width 147 of sight 140 is selected to be about 1 to 1½ inches, the user will only be able to see through a selected portion of the tubes of the tube bundle 142 with a short sight distance 146 of about 1 inch. The farther or larger the sight distance 146 from the rear face 148 of the sight 140, the more tubes will be available for sighting or within the field of view of the eye 144. For example, with a hand held weapon such as weapon 12 of FIG. 1 and the sight position thereon as illustrated in FIG. 1, the weapon 12 may be held at a full arms length so that that sight distance 146 would be virtually the length of the user's arm; and the sight 140 would be sized so the user could see through all the tubes of the bundle. With a rifle, the sight distance 146 might be considerably less since the sighting is effected with the butt of the rifle against the shoulder, and the cheek up against the stock of a conventional rifle (not shown). In that situation, the sight 140 may be of the same size but sighting would be through a selected portion.

It is particularly noted that sighting is to some extent a question of personal choice with present weapons. That is, some prefer to hold the sight close to the eyeball and others prefer to hold it at a greater distance. Whatever the user's preference, beliefs or desires, a sight of the instant invention may be similarly used as long as the effective diameter such as diameter 110 (FIG. 5) is properly selected with respect to the overall length such as length 152.

As seen in FIG. 6, the cross section of the individual tubes of the tube bundle or honeycomb structure 142 is quite small. The user's eye 144 may therefore be placed quite close to the rear face 148 of the sight without suffering any distortion. However, once the user loses sight of the perimeter 150 of the particular sight 140, the user can no longer determine whether or not the target is properly positioned within the central tube without a cross hair or similar type structure to assist the user and identify the proper sight alignment. Optionally, the inside of the tubes may be colored so that the user can ascertain through the use of colors which way the tube or the sight should be moved. For example, if the central or main tube was colored white with each surrounding ring or tubes colored differently, the user would be able to rapidly adjust based on the perceived side wall color to properly align the target with the sight distance 146 very small. For example, where a sight distance 146 is less than one inch for a honeycomb structure such as that illustrated in FIG. 6, where the effective diameter of the tubes (such as diameter 110) is 1/16 of an inch, and where the overall length of the sight 152 is approximately two inches, different color tubes for rings surrounding the main tube facilitate rapid sighting or alignment. In addition or alternatively, the central or main tube 153 may be plugged to prevent sight therethrough. The center tube 153 would then appear as a black dot or button to be positioned on the target but without requiring the user to focus on a close sight device.

Figure 7:
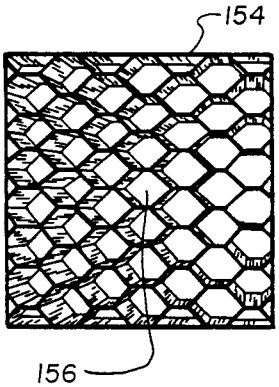
FIG. 7 is a honeycomb sight structure of the instant invention misaligned to the right.
Figure 8:
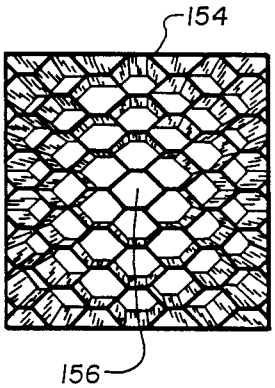
FIG. 8 is a honeycomb sight structure of the instant invention aligned on target.
Figure 9:
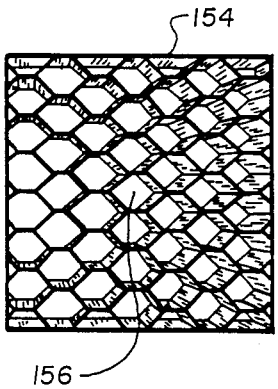
FIG. 9 is a honeycomb sight structure of the instant invention misaligned to the left.

Referring now to FIGS. 7, 8 and 9, use of a sight such as sight 92 and 140 is illustrated. For example, the sight 154 of FIG. 8 is shown in proper alignment upon a target with a central or main tube 156 disposed with its longitudinal axis directly in alignment with the sight axis of the line-of-sight weapon to which the sight 154 is adapted. With the sight 154 out of alignment to the right, the user would observe shadow in the tubes such as seen in FIG. 7 and in particular would observe shadows in the central or main tube 156. With the sight out of alignment to the left, one would observe shadow such as seen in FIG. 9. More particularly, shadows would be seen in the main or central tube 156 as illustrated.

Even though the illustrations of FIGS. 7, 8 and 9 have been described in reference to misalignment to the left or to the right, the sight 154 there illustrated is rectangular so that similar description would apply for misalignment up and down with respect to a target.

Figure 10:
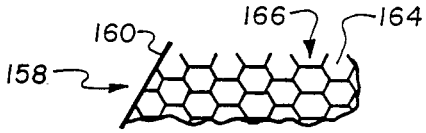
FIG. 10 is a partial cut away cross sectional view of a sight of the instant invention with open portions.

Now referring to FIG. 10, a partial cross sectional piece of a honeycomb sight 158 is shown with a portion of a sheath 160. The portion 158 shown could be adapted, for example, to the sight 92 of FIG. 4. That is, the upper surface 162 of the sheath 114 of FIG. 4 could be removed so that the upper surface of the sight is open such as sight 158 (FIG. 10). With the upper surface of the sheath removed and the sight open, the individual honeycomb or tubes, such as tube 164, has an open side such as open side 166 extending away from the sight. Thus, when the user is aligning the sight, the sight may be brought up from below the target without interference from the sheath facilitating more rapid alignment of the sight on the target.

Figure 11:
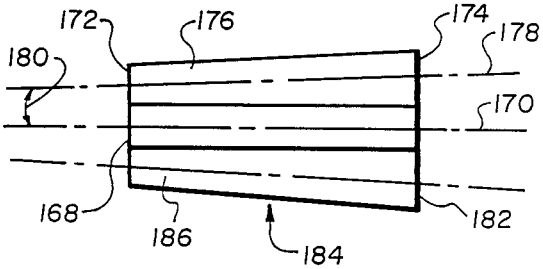
FIG. 11 is a geometrical side view construction representing an alternate sight structure of the instant invention.

Referring to FIG. 11, a portion of a sight 184 of the invention is illustrated graphically with a central or main tube 168 positioned with its longitudinal axis 170 in alignment with sight axis of a line-of-sight weapon. The other tubes positioned about the main tube 170 have a front or muzzle end 172 and a rear or breach end 174. The cross section of the other tubes such as tube 176 is larger at the breach end 174 than at the front or muzzle end 172. The tubes are selected to have a uniformly decreasing cross section, each having a longitudinal axis 178, which can be said to be in a plane intersecting the longitudinal axis 170 of the center or main tube 168. Thus, the longitudinal axis 178 of the other tubes such as tube 176 angle toward the central axis 170 of the central tube 168. The angle therebetween 180 is selected by the user so that when the user's eye, such as eye 144 (FIG. 6), is positioned with respect to the rear 182 or the sight 184 at a sight distance such as sight distance 146 (FIG. 6), the user will be able to see through the main tube 168 as well as through the other tubes such as tube 176 and tube 186. The angle 180 is selected, however, so that upon deliberate misalignment shifting the axis such as axis 178 to be in alignment with the sight axis of the weapon, an appropriate preselected adjustment is thereby made for windage, distance or similar considerations.

Alternately, the sights such as the sight 184 represented by the illustration of FIG. 11 may be fixedly mounted with the axis 170 of the main tube 168 in alignment with the sight axis of the line-of-sight weapon. The conical type tubes such as tubes 176 and 186 may still be positioned thereabout so that with the sight properly aligned on the target, substantial shadow may be seen in the other tubes such as tubes 176 and 186 with absolutely no shadow in the central or main tube 168.

Figure 12:
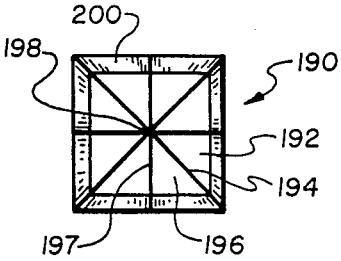
FIG. 12 is an alternate sight structure of the instant invention.

Referring specifically to FIG. 12, a sight 190 has a plurality of tubes such as tubes 192, any one of which may be said to be a main tube having a longitudinal axis in alignment with a sight axis of a line-of-sight weapon. It may be here noted that each of the tubes 192 has three sides. The tubes 192 are assembled so that two adjacent tubes have a common side wall. For example, tubes 192 and 196 have a common side wall 194. The two side walls such as side walls 194 and 197 join to form a corner 198. It is here illustrated that each of the tubes has a common corner 198 which in turn is in fact an axis which is desirably positioned in alignment with sight axis of the line-of-sight weapon. Thus, in aligning a sight such as sight 190, the user will have equidistant shadows such as shadow 200 on all sides of the sight 190 with the corner 198 set on target. Any misalignment such as that discussed with respect to FIGS. 7 and 9 will result in visual shadows and misalignment of the central axis 198 which can be noted without changing one's eye focus with respect to the observed target.

The various sights, such as sights 10, 36, 62, 92, 140, 154, and 190 as illustrated and discussed hereinbefore allow the user to focus his or her eye 144 on the target and not on a sight structure like sights 14 and 16 (FIG. 1). That is, the user is looking through the sight at the target and reacting on a peripheral sense of perceived shadow or color to detect sight misalignment. Stated alternatively, the ability of the eye to recognize light vs. dark or color is used to determine sight alignment rather than the physical orientation of two structures such as may be perceived on a peep sight or open sight such as the sight illustrated on the handgun 12 of FIG. 1. Thus, the user is not required to focus and refocus his or her eye rapidly. At the same time, the user is able to focus 100% of his or her attention on the target, its movement, configuration and the like. The eye's rapid sensitivity to shadow or color change particularly at larger length to diameter ratios provides the user with a rapid determination of even the slightest misalignment of the sight. With larger diameter or effective diameter tubes, the user is able to rapidly bring the sight onto the target and to maintain a proper alignment with very little practice. With smaller diameter or effective diameter tubes, it is still easy to bring the sight into alignment but accuracy is improved with substantially larger length to diameter ratios.

Even though the discussion herein set forth has been principally directed toward handguns or similar types of weapons, such as rifles, bows, and the like, it is within contemplation that the sight herein disclosed and described may be suitable for use with other types of weapons such as machine guns, line-of-sight naval weapons, line-of-sight field artillery and the like.

It should be understood that the above illustrated embodiments are provided to illustrate the principles of the invention and are not intended to limit the scope of the claims.

I claim:

1. A sight comprising:

a tube bundle having a plurality of at least three substantially adjacent and transversely oriented elongated tubes one of which is a main tube having a longitudinal axis substantially parallel with the sight axis of a line-of-sight weapon, each of the tubes of said tube bundle being sized in cross section for visual sight therethrough; and mounting means mechanically associated with said tube bundle for mounting said tube bundle to the line-of-sight weapon with the axis of said main tube substantially parallel with the sight axis of the line-of-sight weapon.

2. The sight of claim 1 wherein said plurality of elongated tubes are of substantially the same length and substantially the same cross section.

3. The sight of claim 1 wherein said main tube is centrally disposed within said bundle.

4. The sight of claim 1 further comprising assembly means sized and shaped to receive and hold said tube bundle together.

5. The sight of claim 4 wherein said assembly means is a sleeve sized to rigidly hold said tube bundle.

6. The sight of claim 2 wherein each of said elongated tubes is substantially circular in cross section.

7. The sight of claim 2 wherein each of said elongated tubes is ovate in cross section.

8. The sight of claim 2 wherein each of said elongated tubes has at least three sides.

9. The sight of claim 8 wherein each of two adjacent elongated tubes have a first common side.

10. The sight of claim 1 wherein each tube of the plurality of tubes has a length dimension and a diameter dimension selected to provide an observable shadow area upon sighting through said tube not along the said longitudinal axis of said tube at a sight distance from said tube selected so that the user is able to see into a selected plurality of tubes of said plurality of tubes.

11. The sight of claim 1 further including cross-hair means positioned to intersect on the longitudinal axis of said main tube.

12. The sight of claim 2 wherein said tube bundle is comprised of at least seven tubes with the said main tube centrally disposed in said tube bundle.

13. The sight of claim 12 wherein said tube bundle includes an additional twelve tubes positioned about the said seven tubes.

14. The sight of claim 13 wherein said tubes are from about 1 inch in length and from about 1/16 of an inch to 1 inch in diameter.

15. The sight of claim 1 wherein satellite tubes are positioned about said main tube in a geometric pattern.

16. A gunsight comprising:

a tube bundle having a plurality of at least seven tubes of substantially the same length and cross section, each having a longitudinal axis parallel with the longitudinal axes of the others, each of said tubes being formed to be polygonal in cross section with each adjacent of said tubes uniformly formed to have a common side and wherein at least one of said tubes has two tubes adjacent thereto at each of two adjacent sides;

tube assembly means adapted to receive and fixedly hold said tube bundle; and mounting means adapted to said tube assembly means for mounting said tube bundle to a gun with the longitudinal axis of said tubes substantially parallel with the sight axis of the gun.

17. The gunsight of claim 16 wherein said tubes are at least six-sided with a length to diameter ratio of from about 4 to 1 to about 50 to 1.

18. A sight comprising:

a tube bundle having a plurality of elongated tubes one of which is a main tube having a longitudinal axis substantially parallel with the sight axis of a line-of-sight weapon, centrally disposed within said tube bundle, said main tube being surrounded by other tubes of said tube bundle, each of said tubes of said tube bundle being sized in cross section for visual sight therethrough, said other tubes of said tube bundle having a distal end orientable toward the front of the line-of-sight weapon and a proximal end oriented toward the back of the line-of-sight weapon, said proximal end having a cross section larger than said distal end; and mounting means mechanically associated with said tube bundle for mounting said tube bundle to the line-of-sight weapon with the axis of said main tube substantially parallel with the sight axis fo the line-of-sight weapon.

19. The sight of claim 18 wherein one of the said other tubes has a longitudinal axis and is positioned with its longitudinal axis at an angle with respect to the longitudinal axis of said main tube.

20. A sight comprising:

a tube bundle having a plurality of elongated tubes one of which is a main tube haivng a longitudinal axis substantially parallel with the sight axis of a line-of-sight weapon, each of said tubes of said tube bundle being sized in cross section for visual sight therethrough; and mounting means mechanically associated with said tube bundle for mounting said tube bundle to the line-of-sight weapon with the axis of said main tube substantially parallel with the sight axis of the line-of-sight weapon;

assembly means sized and shaped to receive and hold said tube bundle together, said assembly means including a first bracket formed of a rigid material and a second bracket formed of a rigid material and spaced from said first bracket.

21. A sight comprising:

a tube bundle having a plurality of elongated tubes one of which is a main tube having a longitudinal axis substantially parallel with the sight axis of a line-of-sight weapon, each of said tubes of said tube bundle being sized in cross section for visual sight therethrough, said tube bundle having a height and a width wherein said width is larger than said height; and mounting means mechanically associated with said tube bundle for mounting said tube bundle to the line-of-sight weapon with the axis of said main tube substantially parallel with the sight axis of the line-of-sight weapon.

22. A sight comprising:

a tube bundle having a plurality of elongated tubes one of which is a main tube having a longitudinal axis substantially parallel with the sight axis of a line-of-sight weapon, each of said tubes of said tube bundle being sized in cross section for visual sight therethrough, each tube of said elongated tubes having a length dimension and a diameter dimension and wherein each said tube has a length dimension to diameter dimension ratio of at least about 4 to 1; and mounting means mechanically associated with said tube bundle for mounting said tube bundle to the line-of-sight weapon with the axis of said main tube substantially parallel with the sight axis of the line-of-sight weapon.

23. A sight comprising:

a tube bundle having a plurality of elongated tubes one of which is a main tube having a longitudinal axis substantially parallel with the sight axis of a line-of-sight weapon, each of said tubes of said tube bundle being sized in cross section for visual sight therethrough, each of said elongated tubes having a first side and a second side joined at one edge thereof to form a corner, the first side of a first elongated tube being adjacent the first side of a second elongated tube, the second side of the said first elongated tube being adjacent the second side of a third elongated tube and the corners of each elongated tube being substantially parallel to said sight axis of said line-of-sight weapon; and mounting means mechanically associated with said tube bundle for mounting said tube bundle to the line-of-sight weapon with the axis of said main tube substantially parallel with the sight axis of the line-of-sight weapon.

24. The sight of claim 23 wherein said first and second sides are each unitarily formed with the corner of each formed to be a common single corner.

25. The sight of claim 24 wherein said common single corner is in alignment with the sight axis of said gun.

26. A sight comprising:

a tube bundle having a plurality of elongated tubes one of which is a main tube having a longitudinal axis substantially parallel with the sight axis of a line-of-sight weapon, each of said tubes being sized in cross section for visual sight therethrough;

mounting means mechanically associated with said tube bundle for mounting said tube bundle to the line-of-sight weapon with the axis of said main tube substantially parallel with the sight axis of the line-of-sight weapon; and partial tube means adapted to said tube bundle, said partial tube means being comprised of adjacent elongated tubes with an open side wall portion facing outwardly from said tube bundle.

27. The sight of claim 26 wherein said main tube is plugged to preclude sight therethrough.

28. A gunsight comprising:

a tube bundle having a plurality of at least seven tubes of substantially the same length and cross section each having a longitudinal axis parallel with the longitudinal axes of the others, each of said tubes of said tube bundle being formed to be polygonal in cross section with each adjacent of said tubes being uniformly formed to have a common side, said tubes being at least six-sided with a length to diameter ratio of from about 4 to 1 to about 50 to 1, and said tubes of said tube bundle being formed into a honeycombed structure with one tube being a main tube centrally disposed in said honeycomb structure, and wherein said main tube is plugged to preclude sight therethrough;

tube assembly means adapted to receive and fixedly hold said tube bundle; and mounting means adapted to said tube assembly means for mounting said tubes to a gun with the longitudinal axis of said tubes substantially parallel with the sight axis of the gun.

* * * * *